US009138615B2

(12) United States Patent
Olson et al.

(10) Patent No.: US 9,138,615 B2
(45) Date of Patent: Sep. 22, 2015

(54) EXERCISE DEVICE WITH RACK AND PINION INCLINE ADJUSTING MECHANISM

(71) Applicant: Icon Health & Fitness, Inc., Logan, UT (US)

(72) Inventors: Michael Olson, Logan, UT (US); William T. Dalebout, North Logan, UT (US); Kent Smith, Nibley, UT (US); Trenton V. Larsen, Hyrum, UT (US); Gordon Cutler, Providence, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 361 days.

(21) Appl. No.: 13/652,568

(22) Filed: Oct. 16, 2012

(65) Prior Publication Data

US 2013/0123073 A1 May 16, 2013

Related U.S. Application Data

(60) Provisional application No. 61/559,834, filed on Nov. 15, 2011.

(51) Int. Cl.
*A63B 22/02* (2006.01)
*A63B 22/00* (2006.01)

(52) U.S. Cl.
CPC ..... *A63B 22/02* (2013.01); *A63B 22/0023* (2013.01); *A63B 22/0235* (2013.01); *A63B 2210/50* (2013.01); *A63B 2220/13* (2013.01); *A63B 2220/89* (2013.01)

(58) Field of Classification Search
CPC ..... A63B 22/0023; A63B 22/02; A63B 2210/50; A63B 22/0015; A63B 22/0235; A63B 22/0264; A63B 2220/13; A63B 2220/89; A63B 2225/09; A63B 2225/093
USPC ..... 482/51–54, 908; 119/700
See application file for complete search history.

(56) References Cited

U.S. PATENT DOCUMENTS 4,729,558 A 3/1988 Kuo
5,352,167 A 10/1994 Ulicny
5,816,981 A 10/1998 Hung (Continued)

FOREIGN PATENT DOCUMENTS

WO 2006004430 1/2006

OTHER PUBLICATIONS

International Search Report, PCT/US2012/060635, Oct. 17, 2012.

*Primary Examiner* — Oren Ginsberg
*Assistant Examiner* — Gregory Winter
(74) *Attorney, Agent, or Firm* — Holland & Hart LLP

(57) ABSTRACT

Incline mechanisms are provided for adjusting an incline of an inclinable portion of an exercise device. The incline mechanism may include one or more racks disposed on a frame, such as a generally upright support structure of a treadmill. One or more pinions may be movably connected to the inclinable portion of the exercise device, such as a tread-base of a treadmill, and may engage the one or more racks. An incline motor may rotate the pinions, which causes the pinions to ride up or down the racks. As the pinions rides up or down the racks or linear gear bars, the incline of the inclinable portion of the exercise device is increased or decreased. The pinions may rotate between various positions on the racks which correspond to various inclines and declines, including fully inclined, fully declined, and neutral positions.

20 Claims, 9 Drawing Sheets

(56) References Cited

U.S. PATENT DOCUMENTS

| | | | | |
|---|---|---|---|---|
| 5,833,577 | A * | 11/1998 | Hurt | 482/54 |
| 5,860,893 | A | 1/1999 | Watterson et al. | |
| 5,868,648 | A * | 2/1999 | Coody et al. | 482/54 |
| 6,110,076 | A | 8/2000 | Hurt | |
| 6,261,209 | B1 | 7/2001 | Coody | |
| 6,585,624 | B1 * | 7/2003 | Chen | 482/54 |
| 6,761,667 | B1 | 7/2004 | Cutler et al. | |
| 6,913,563 | B2 | 7/2005 | Chen | |
| 6,926,644 | B2 | 8/2005 | Chen | |
| 7,041,038 | B2 | 5/2006 | Smith et al. | |
| 7,192,388 | B2 * | 3/2007 | Dalebout et al. | 482/54 |
| 7,285,075 | B2 | 10/2007 | Cutler et al. | |
| 7,537,549 | B2 | 5/2009 | Nelson et al. | |
| 7,540,828 | B2 | 6/2009 | Watterson et al. | |
| 7,736,280 | B2 * | 6/2010 | Weier et al. | 482/54 |
| 7,862,483 | B2 | 1/2011 | Ashby et al. | |
| 2002/0016235 | A1 * | 2/2002 | Ashby et al. | 482/8 |
| 2003/0236153 | A1 * | 12/2003 | Pan et al. | 482/54 |
| 2005/0130807 | A1 * | 6/2005 | Cutler et al. | 482/54 |
| 2006/0240951 | A1 * | 10/2006 | Wang | 482/54 |
| 2007/0087908 | A1 * | 4/2007 | Pan et al. | 482/54 |
| 2009/0111666 | A1 * | 4/2009 | Wang | 482/54 |
| 2011/0124466 | A1 * | 5/2011 | Nishimura | 482/4 |

* cited by examiner

EXERCISE DEVICE WITH RACK AND PINION INCLINE ADJUSTING MECHANISM

CROSS-REFERENCE TO RELATED APPLICATIONS

This application claims priority to and the benefit of U.S. Provisional Patent Application No. 61/559,834, filed on Nov. 15, 2011, and entitled EXERCISE DEVICE WITH RACK AND PINION INCLINE ADJUSTING MECHANISM, which is incorporated herein by reference in its entirety.

TECHNICAL FIELD

This invention relates generally to systems, methods, and devices for exercise. More particularly, the invention relates to a motorized system used to increase and decrease the inclination of an exercise device.

BACKGROUND

Inclining exercise devices, such as treadmills, have become very popular for use in improving individuals' health and fitness. Exercising on an inclined exercise device often requires more exertion than exercising on a flat surface or a non-inclined exercise device, thereby providing a more intense, challenging workout.

Inclining exercise devices often include a lift mechanism, such as a lift motor, for inclining a portion of the exercise device. One common challenge with exercise device lift motors is making the lift motor compact enough to accommodate the aesthetic and space limitations desirable for exercise devices while also providing sufficient lifting force and desired inclination ranges. Examples of various exercise device lift mechanisms are described in U.S. Pat. Nos. 4,729,558, 5,816,981, 6,761,667, 6,913,563, 6,926,644, 7,041,038, 7,285,075, 7,537,549, and 7,862,483.

SUMMARY OF THE INVENTION

In one aspect of the disclosure, a selectively inclining treadmill which supports a user ambulating thereon.

In another aspect that may be combined with any of the aspects herein, the selectively inclining treadmill includes a frame, a treadbase, and an incline mechanism.

In another aspect that may be combined with any of the aspects herein, the treadbase is pivotally connected to the frame.

In another aspect that may be combined with any of the aspects herein, the treadbase has a first end and a second end.

In another aspect that may be combined with any of the aspects herein, the treadbase is selectively movable between a declined position, a neutral position, and an inclined position relative to a support surface.

In another aspect that may be combined with any of the aspects herein, the incline mechanism selectively moves the treadbase between the declined, neutral, and inclined positions.

In another aspect that may be combined with any of the aspects herein, the incline mechanism includes a rack connected to the frame.

In another aspect that may be combined with any of the aspects herein, the incline mechanism includes a pinion rotatably connected to the first end of the treadbase.

In another aspect that may be combined with any of the aspects herein, the pinion selectively rotates up and down the rack to move the treadbase between the declined, neutral, and inclined positions.

In another aspect that may be combined with any of the aspects herein, the incline mechanism includes a motor that selectively rotates the pinion up and down the rack.

In another aspect that may be combined with any of the aspects herein, the incline mechanism enables the treadbase to decline to about a −5% grade and incline to about a 30% grade relative to the support surface.

In another aspect that may be combined with any of the aspects herein, the rack and the pinion each comprises a plurality of teeth that engage one another.

In another aspect that may be combined with any of the aspects herein, the first end of the treadbase is rotatably mounted on a rod to enable the treadbase to be selectively reoriented between an operating position and a storage position.

In another aspect that may be combined with any of the aspects herein, the treadbase is generally vertically oriented when the treadbase is in the storage position.

In another aspect that may be combined with any of the aspects herein, the pinion is mounted on the rod.

In another aspect that may be combined with any of the aspects herein, the treadmill also includes a handle bar assembly pivotally connected to the frame.

In another aspect that may be combined with any of the aspects herein, the handle bar assembly may be selectively reoriented between an operating position and a storage position.

In another aspect that may be combined with any of the aspects herein, the handle bar assembly is generally vertically oriented when the handle bar assembly is in the storage position.

In another aspect that may be combined with any of the aspects herein, the handle bar assembly is reoriented from the operating position to the storage position when the treadbase is reoriented from an operating position to a storage position.

In another aspect that may be combined with any of the aspects herein, the treadmill has a storage profile width of between about 4 inches and about 12 inches when the treadbase and handle bar assembly are in the storage positions.

In another aspect that may be combined with any of the aspects herein, the treadmill also includes a bracket assembly, a guide, and a gas spring that cooperate to maintain full engagement between the pinion and the rack.

In another aspect that may be combined with any of the aspects herein, the guide comprises an opening formed therein.

In another aspect that may be combined with any of the aspects herein, at least a portion of the bracket assembly moves back and forth within the opening of the guide as the incline mechanism moves the treadbase between the declined, neutral, and inclined positions.

In another aspect that may be combined with any of the aspects herein, the treadmill also includes a latching mechanism.

In another aspect that may be combined with any of the aspects herein, the latching mechanism includes a latch plate connected to the frame.

In another aspect that may be combined with any of the aspects herein, the latch plate has a channel formed therein.

In another aspect that may be combined with any of the aspects herein, the latching mechanism includes a latch pin connected to the first end of the treadbase.

In another aspect that may be combined with any of the aspects herein, the latch pin may be selectively lowered into the channel when the treadbase is in a storage position.

In another aspect that may be combined with any of the aspects herein, the latch pin and the channel cooperate to maintain the treadbase in the storage position when the latch pin is positioned within the channel.

In another aspect that may be combined with any of the aspects herein, the latch pin is lowered into the channel by activating the incline mechanism.

In another aspect that may be combined with any of the aspects herein, the latch pin may be aligned with the channel when the treadbase is in the storage position.

In another aspect that may be combined with any of the aspects herein, the latch pin may be aligned with the channel in a generally vertical direction, a generally horizontal direction, or in an angled direction relative to a support surface.

In another aspect that may be combined with any of the aspects herein, the treadbase may move vertically to position the latch pin within or remove the latch pin from the channel.

In another aspect that may be combined with any of the aspects herein, the treadbase may move horizontally to position the latch pin within or remove the latch pin from the channel.

In aspect that may be combined with any of the aspects herein, the treadbase may move at an angle relative to a support surface to position the latch pin within or remove the latch pin from the channel.

In another aspect that may be combined with any of the aspects herein, a selectively reorienting treadmill includes a frame, a treadbase, and a latching mechanism.

In another aspect that may be combined with any of the aspects herein, the frame rests upon a support surface.

In another aspect that may be combined with any of the aspects herein, the treadbase is pivotally connected to the frame.

In another aspect that may be combined with any of the aspects herein, the treadbase has a first end and a second end and is selectively movable between an operating position and a storage position.

In another aspect that may be combined with any of the aspects herein, the latching mechanism that selectively maintains the treadbase in the storage position.

In another aspect that may be combined with any of the aspects herein, the latching mechanism includes a latch plate connected to the frame, the latch plate having a generally upwardly opening channel formed therein.

In another aspect that may be combined with any of the aspects herein, the latching mechanism includes a latch pin connected to the first end of the treadbase.

In another aspect that may be combined with any of the aspects herein, the latch pin may be selectively lowered into the channel when the treadbase is in a storage position.

In another aspect that may be combined with any of the aspects herein, the latch pin and the channel cooperate to maintain the treadbase in the storage position when the latch pin is positioned within the channel.

In another aspect that may be combined with any of the aspects herein, the latch pin is lowered into the channel by lowering the treadbase closer to the latch plate.

In another aspect that may be combined with any of the aspects herein, the treadmill also includes an incline mechanism that selectively adjusts the height of the first end of the treadbase when the treadbase is in the operating position and that lowers the treadbase to position the latch pin in the channel when the treadbase is in the storage position.

In another aspect that may be combined with any of the aspects herein, the incline mechanism is a rack and pinion incline mechanism.

In another aspect that may be combined with any of the aspects herein, a treadmill includes a frame, a treadbase, a latching mechanism, and an incline mechanism.

In another aspect that may be combined with any of the aspects herein, the treadbase is pivotally connected to the frame, wherein the treadbase may be selectively reoriented between an operating position and a storage position, and wherein the treadbase is selectively movable between a declined position, a neutral position, and an inclined position when the treadbase is in the operating position.

In another aspect that may be combined with any of the aspects herein, the latching mechanism has a latch pin connected to the treadbase and a latch plate with a channel formed therein connected to the frame, wherein the channel selectively receives the latch pin when the treadbase is in the storage position to selectively maintain the treadbase in the storage position.

In another aspect that may be combined with any of the aspects herein, the incline mechanism selectively moves the treadbase between the declined, neutral, and inclined positions when the treadbase is in the operating position, and selectively lowers the treadbase to position the latch pin within the channel when the treadbase is in the storage position.

In another aspect that may be combined with any of the aspects herein, the treadbase rotates between operating and storage positions about a pivot point that can move vertically with little or no horizontal movement.

In another aspect that may be combined with any of the aspects herein, an exercise device includes a support base, an upright support structure connected to the support base, and an incline mechanism that adjusts to tilt of the upright support structure relative to the support base.

In another aspect that may be combined with any of the aspects herein, the incline mechanism includes a worm wheel fixedly connected to the upright support structure.

In another aspect that may be combined with any of the aspects herein, the incline mechanism includes a worm connected to the support base such that the worm is rotatable about it longitudinal axis.

In another aspect that may be combined with any of the aspects herein, rotation of the worm in a first direction about it longitudinal axis causes the worm wheel to rotate in a first direction about its central axis.

In another aspect that may be combined with any of the aspects herein, rotation of the worm wheel in the first direction causes the upright support structure to tilt in a first direction.

In another aspect that may be combined with any of the aspects herein, rotation of the worm in a second direction about it longitudinal axis causes the worm wheel to rotate in a second direction about its central axis.

In another aspect that may be combined with any of the aspects herein, rotation of the worm wheel in the second direction causes the upright support structure to tilt in a second direction.

DETAILED DESCRIPTION

Figure 1:
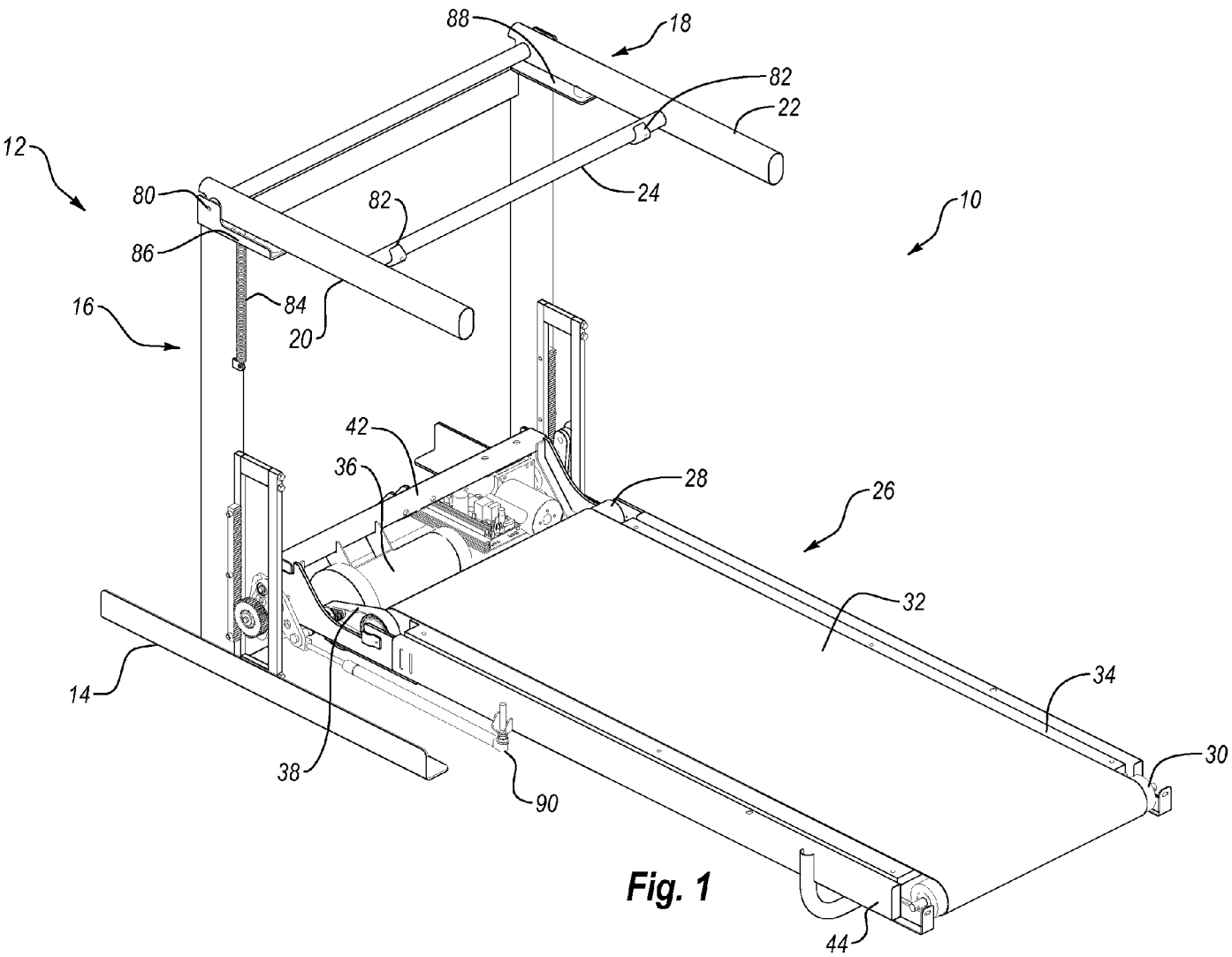
FIG. 1 illustrates an exercise device according to one embodiment of the present invention.

Depicted in FIG. 1 is a representation of an exercise device 10 according to one embodiment of the present invention. Exercise device 10, which is illustrated as a treadmill, includes a frame 12 having a base 14 and a generally upright support structure 16. Connected to the upper end of support structure 16 is an optional handle bar assembly 18. In the illustrated embodiment, handle bar assembly 18 includes generally parallel handle bars 20, 22 and cross bar 24 connected between handle bars 20, 22. Cross bar 24 may optionally be designed and used as a handle bar. In the illustrated embodiment, cross bar 24 is horizontally offset from support structure 16. An optional console with a display and/or one or more inputs may optionally be mounted on support structure 16 and/or handle bar assembly 18.

A treadbase 26 is connected to support structure 16 and typically includes front and rear pulleys 28, 30 with a continuous belt 32 extending between and around front and rear pulleys 28, 30, respectively. Front and rear pulleys 28, 30 and continuous belt 32 may each be considered a movable element that is movable during the performance of an exercise. A deck 34, commonly fabricated from wood, metal or a composite material such as fiber glass, typically supports the upper run of belt 32 and an exercising individual positioned upon belt 32.

As is common with electrically-powered treadmills, at least one of front pulley 28 and rear pulley 30 may be mechanically connected to an electric drive motor 36 by way of a drive belt 38. In the illustrated embodiment, drive motor 36 is connected to front pulley 28 via drive belt 38 in order to turn front pulley 28 and, in turn, rotate belt 32. Motor 36 is optionally electrically connected to a controller 40 that controls the operation of motor 36, and thus the speed of belt 32, in response to various user inputs or other control signals.

In addition to the ability to control and vary the speed of belt 32, exercise device 10 also permits the degree of incline or decline of treadbase 26, and thus belt 32, to be varied relative to base 14, or the floor or other support surface upon which exercise device 10 rests. To facilitate various inclines and declines of treadbase 26, treadbase 26 may be movably connected to support structure 16. As shown in FIG. 1, for example, a first end 42 of treadbase 26 is movably connected to support structure 16 to allow the height of first end 42 to change relative to base 14, a support surface, or a second end 44 of treadbase 26. As is understood, changing the height of first end 42 increases or decreases the incline of treadbase 26.

Figure 2:
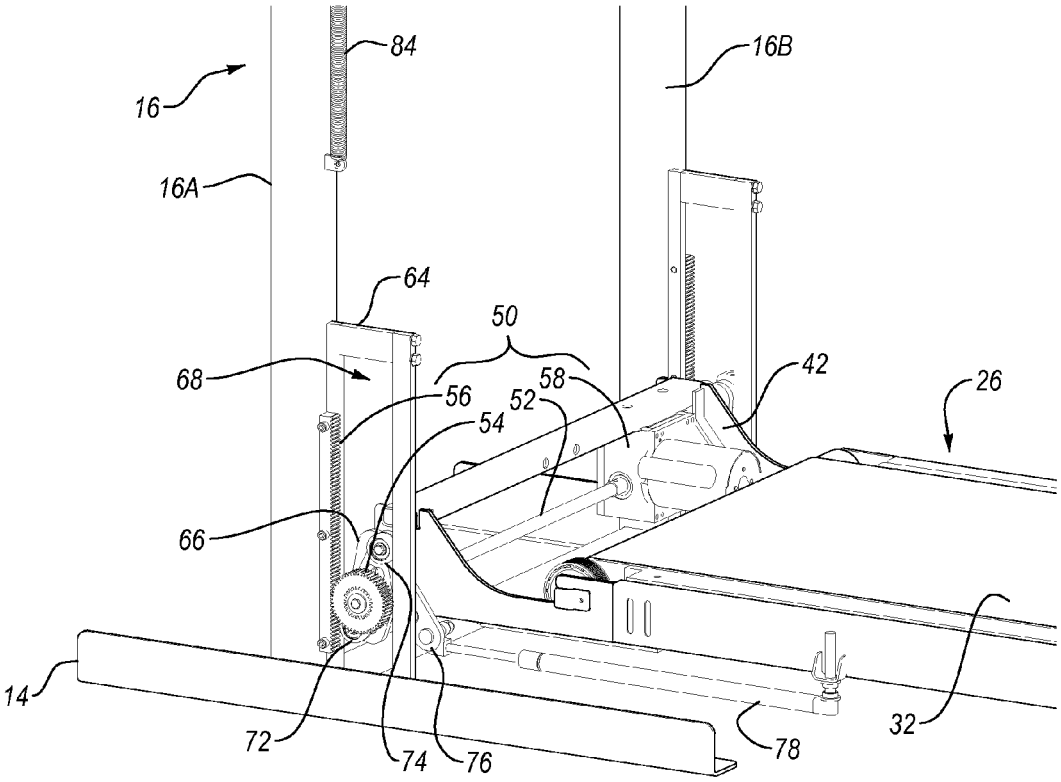
FIG. 2 illustrates a partial perspective view of the exercise device of FIG. 1 showing an incline mechanism.

With reference to FIG. 2, exercise device 10 includes an incline mechanism 50 that adjusts the incline of treadbase 26 by adjusting the height of first end 42 of treadbase 26. As shown, the incline mechanism 50 may optionally be vertically aligned with and attached to the upright support structure 16.

In the illustrated embodiment, incline mechanism 50 includes a rod 52, pinions 54, racks 56, and an incline motor 58. Rod 52 has a pinion 54 fixedly connected on at least one end, and preferably both ends thereof. Each pinion 54 engages a rack 56, or linear gear bar, on support structure 16. More specifically, in the illustrated embodiment, a rack 56 is connected to each of the two generally vertical members 16A, 16B of support structure 16. Pinions 54 and racks 56 have teeth that engage one another. Incline motor 58 is mounted on first end 42 of treadbase 26 and rotates rod 52, which causes pinions 54 to likewise rotate. The engagement between the teeth of pinions 54 and racks 56 and the rotation of pinions 54 causes pinions 54 to move up and down racks 56.

Figure 3:
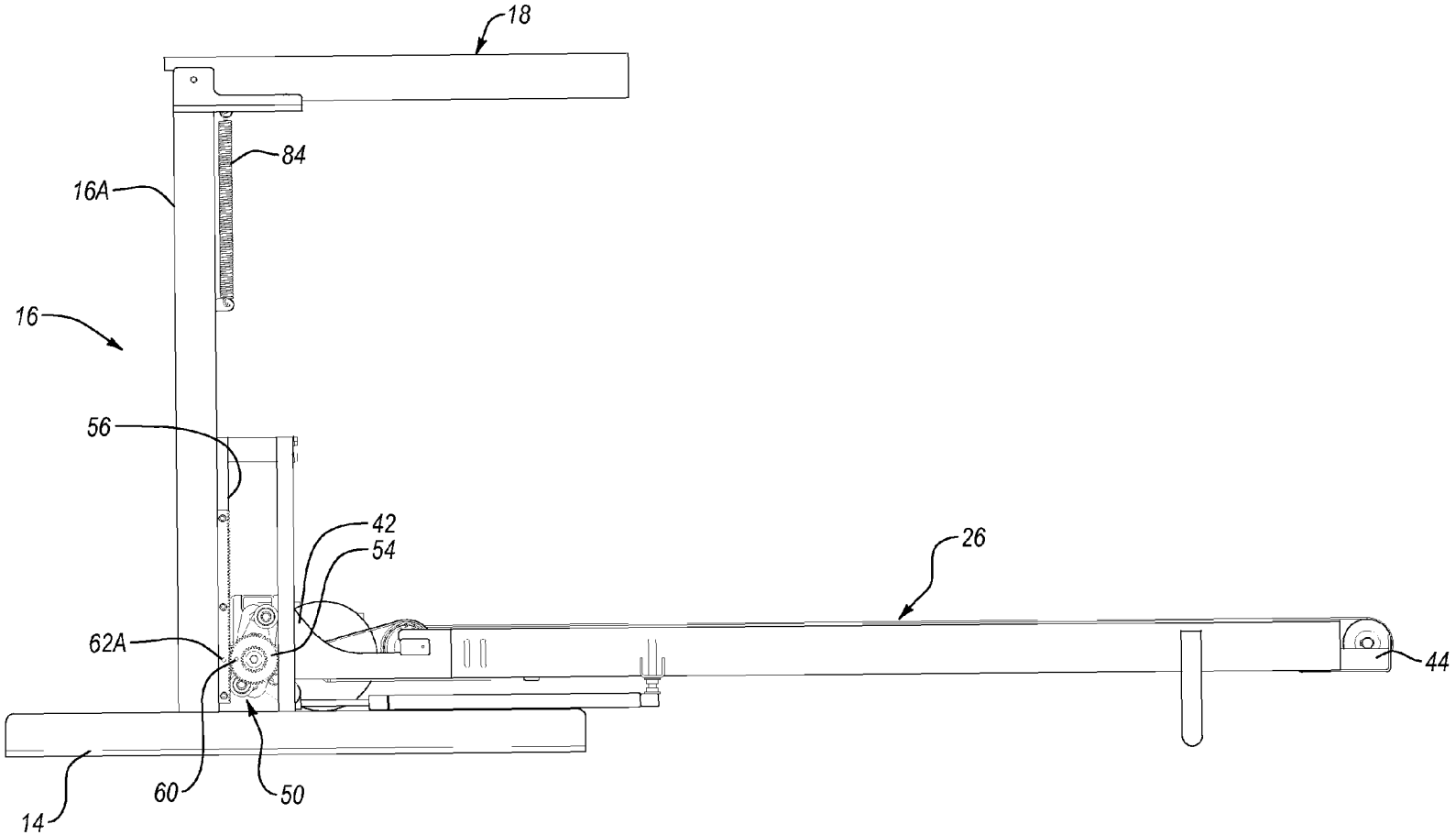
FIG. 3 illustrates a side elevation view of the exercise device of FIG. 1 with the exercise device in a neutral position.

First end 42 of treadbase 26 is rotatably mounted on rod 52 such that rod 52 is able to rotate relative to treadbase 26 and, as will be discussed below, such that treadbase 26 is able to rotate about and relative to rod 52. As pinions 54 move up and down racks 56, the height of first end 42, and thus the incline of treadbase 26, is adjusted between a variety of positions. For instance, pinions 54 may be moved to an intermediate position that orients treadbase 26 in a neutral position as shown in FIG. 3. When in the neutral position, treadbase 26 may be generally parallel to base 14 and/or a support surface upon which exercise device 10 rests. In other words, pinions 54 may move up or down racks 56 to an intermediate position that causes treadbase 26 to pivot, rotate, or be otherwise reoriented so that first and second ends 42, 44 are generally level with one another. When treadbase 26 is in the neutral position, treadbase 26 may replicate a generally flat, level surface for a user ambulating on exercise device 10.

Figure 4:
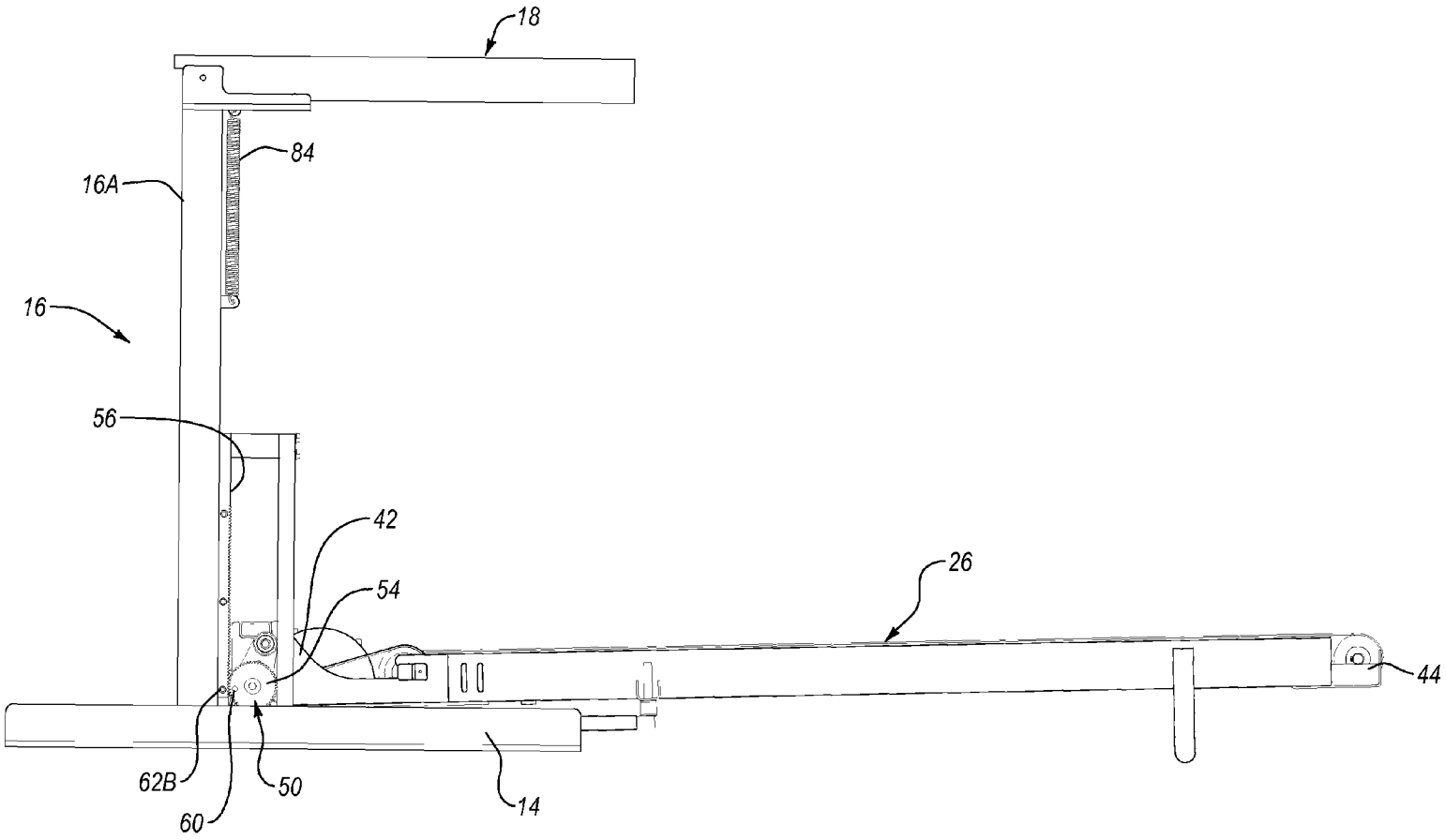
FIG. 4 illustrates a side elevation view of the exercise device of FIG. 1 with the exercise device in a declined position.

When pinions 54 rotate down racks 56 to the vertically lowest ends of racks 56, treadbase 26 may be in a fully declined position as shown in FIG. 4. In the fully declined position, first end 42 of treadbase 26 may be positioned vertically lower than second end 44 of treadbase 26. A declined position of treadbase 26 replicates for a user the experience of ambulating down a hill.

Figure 5:
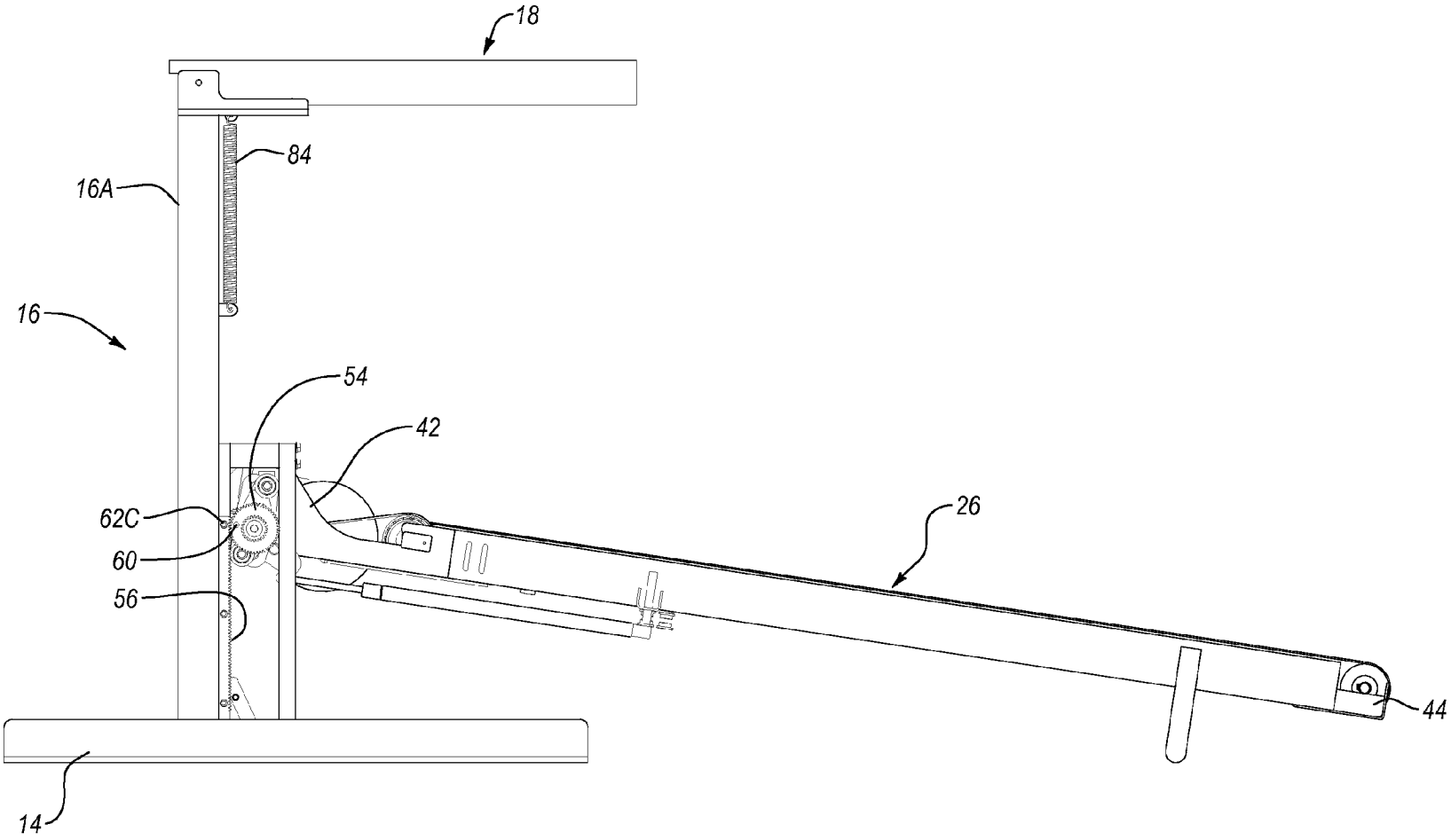
FIG. 5 illustrates a side elevation view of the exercise device of FIG. 1 with the exercise device in an inclined position.

As shown in FIG. 5, treadbase 26 may be moved to a fully inclined position by rotating pinions 54 up to the vertically highest ends of racks 56. In the fully inclined position, first end 42 of treadbase 26 may be positioned vertically higher than second end 44 of treadbase 26. An inclined position of treadbase 26 replicates for a user the experience of ambulating up a hill.

In addition to the ability of incline mechanism 50 to move treadbase 26 between fully declined, neutral, and fully inclined positions, incline mechanism 50 may also move treadbase 26 to substantially any position between the fully declined and fully inclined positions.

Incline mechanism 50 may also allow for treadbase 26 to be readily inclined or reoriented to certain positions, such as the fully declined, fully inclined, and neutral positions. For instance, one or more magnets 60 may be positioned on or in pinion 54 and one or more sensors 62 may be positioned on or adjacent rack 56. The one or more sensors 62 may be capable of detecting the magnetic field surrounding magnets 60 when magnets 60 are in close proximity to the sensors 62.

For instance, as shown in FIG. 3, a sensor 62A may be positioned on rack 56 so that magnet 60 is in close proximity to sensor 62A when treadbase 26 is in the neutral position. Sensor 62A may be in communication with incline motor 58 and/or controller 40. When magnet 60 moves into close proximity to sensor 62A, sensor 62A may send a signal to incline motor 58 and/or controller 40. In response to the signal from sensor 62A, incline motor 58 and/or controller 40 may stop the movement of pinions 54 so that treadbase 26 stops in the neutral position. Thus, in response to a control signal or a user input requesting that treadbase 26 be moved to the neutral position, incline motor 58 may rotate pinions 54 up or down racks 56 until magnet 60 is in close proximity to sensor 62A, at which point the rotation of pinions 54 will be stopped and treadbase 26 will be in the neutral position.

As shown in FIGS. 4 and 5, additional sensors 62 may be positioned along rack 56 to facilitate the positioning of treadbase 26 at different inclines. For instance, FIG. 4 illustrates a sensor 62B positioned near the lower end of rack 56. When pinions 54 rotate down racks 56, magnet 60 will move into close proximity to sensor 62B. Sensor 62B may detect the presence of magnet 60 and communicate with incline motor 58 and/or controller 40 to stop the movement of pinions 54 so as to position treadbase 26 in the fully declined position shown in FIG. 4. Likewise, a sensor 62C may be positioned near the top of rack 56 to facilitate the positioning of treadbase 26 in the fully inclined position, as shown in FIG. 5.

Although only one magnet 60 has been shown in association with pinion 54, it is understood that multiple magnets may be associated with pinions 54. Similarly, racks 56 may include fewer or more than three sensors 62 to facilitate the ready positioning of treadbase 26 in any number of inclined or declined positions. It is also understood that other types of position switches may be employed, including mechanical switches, electrical switches, electromechanical switches, and the like.

Figure 6:
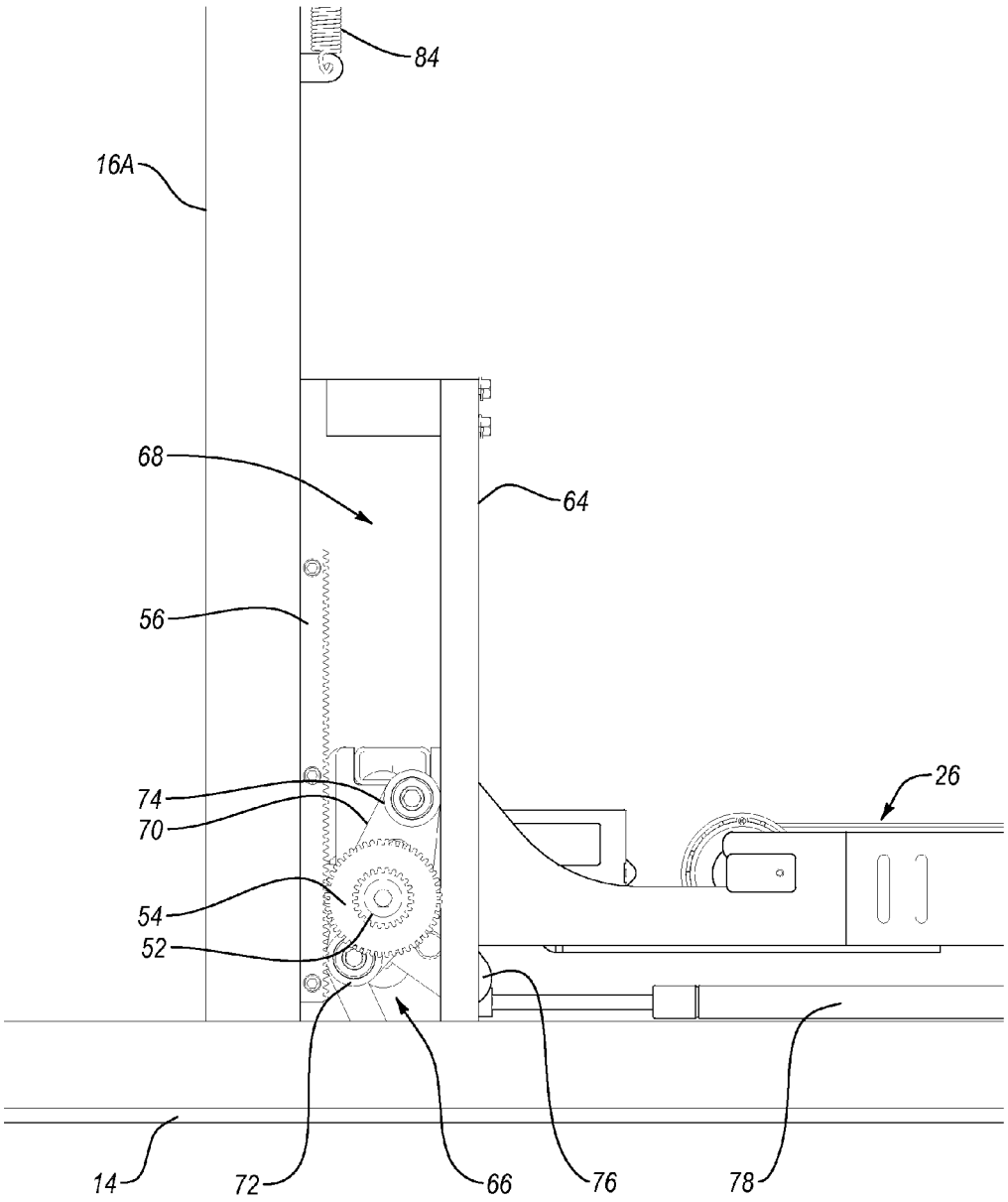
FIG. 6 illustrates a partial side elevation view of the incline mechanism of FIG. 2.

With reference to FIGS. 2 and 6, a guide 64 and a bracket assembly 66 will be described. While a guide 64 and a bracket assembly 66 may be, but are not necessarily, included on both sides of exercise device 10, the following discussion will focus on a guide and bracket assembly on one side of exercise device 10, with the understanding that a guide and bracket assembly on the other side, if any, may be similar or identical.

As can be seen in FIGS. 2 and 6, guide 64 is a generally rectangular frame connected to the rear side of vertical member 16A. Guide 64 includes a generally rectangular opening 68 therethrough. Guide 64 directs the movement of bracket assembly 66 and cooperates with bracket assembly 66 to maintain full engagement between pinion 54 and rack 56.

Bracket assembly 66 includes a first bracket 70 mounted on rod 52 such that rod 52 may rotate relative to first bracket 70. First bracket 70 has first and second wheels 72, 74 rotatably mounted on opposing ends thereof and which roll against the inner surface of opening 68 in guide 64. Bracket assembly 66 also includes a second bracket 76 fixedly connected to first bracket 70. A first end of second bracket 76 is mounted on rod 52 such that rod 52 may rotate relative to second bracket 76, while a second end of second bracket 76 extends away from rod 52.

A gas spring 78 is connected between the second end of second bracket 76 and treadbase 26 as shown in FIG. 2. Gas spring 78 applies a continuous force between the second end of bracket 76 and the connection point between gas spring 78 and treadbase 26. The force from gas spring 78 continuously tries to rotate bracket assembly 66 clockwise (when viewed from the perspective shown in FIG. 6) about rod 52. Various benefits are achieved as a result of the force applied to bracket assembly 66 by gas spring 78. For instance, first and second wheels 72, 74 are continuously pushed into engagement with the opposing inner surfaces of opening 68 in guide 64, as shown throughout the Figures. The continuous engagement between wheels 72, 74 and the opposing inner surfaces of opening 68 maintains rod 52 in a substantially fixed horizontal position. That is, the continuous engagement between wheels 72, 74 and the opposing inner surfaces of opening 68 maintains rod 52 in substantially the same horizontal position, even when the height of first end 42 of treadbase 26, and thus the height of rod 52, is adjusted. In other words, bracket assembly 66 and gas spring 78 cooperate to restrict the movement of rod 52 (or a center point thereof) to within a single plane that is substantially parallel to racks 56. In the illustrated embodiment, racks 56 are substantially vertical, thus rod 52 is able to move vertically, but not horizontally.

As noted above, pinions 54 are mounted on the opposing ends of rod 52. As a result, restricting the movement of rod 52 (or a center point thereof) to within a single plane that is substantially parallel to racks 56 likewise restricts the movement of pinions 54 (or a center point thereof) to within a plane that is substantially parallel to racks 56. In the illustrated embodiment, for example, pinions 54 are able to move vertically, but not horizontally. As a result, pinions 54 remain fully engaged with racks 56 regardless of the vertical position or vertical movements of pinions 54.

Figure 7:
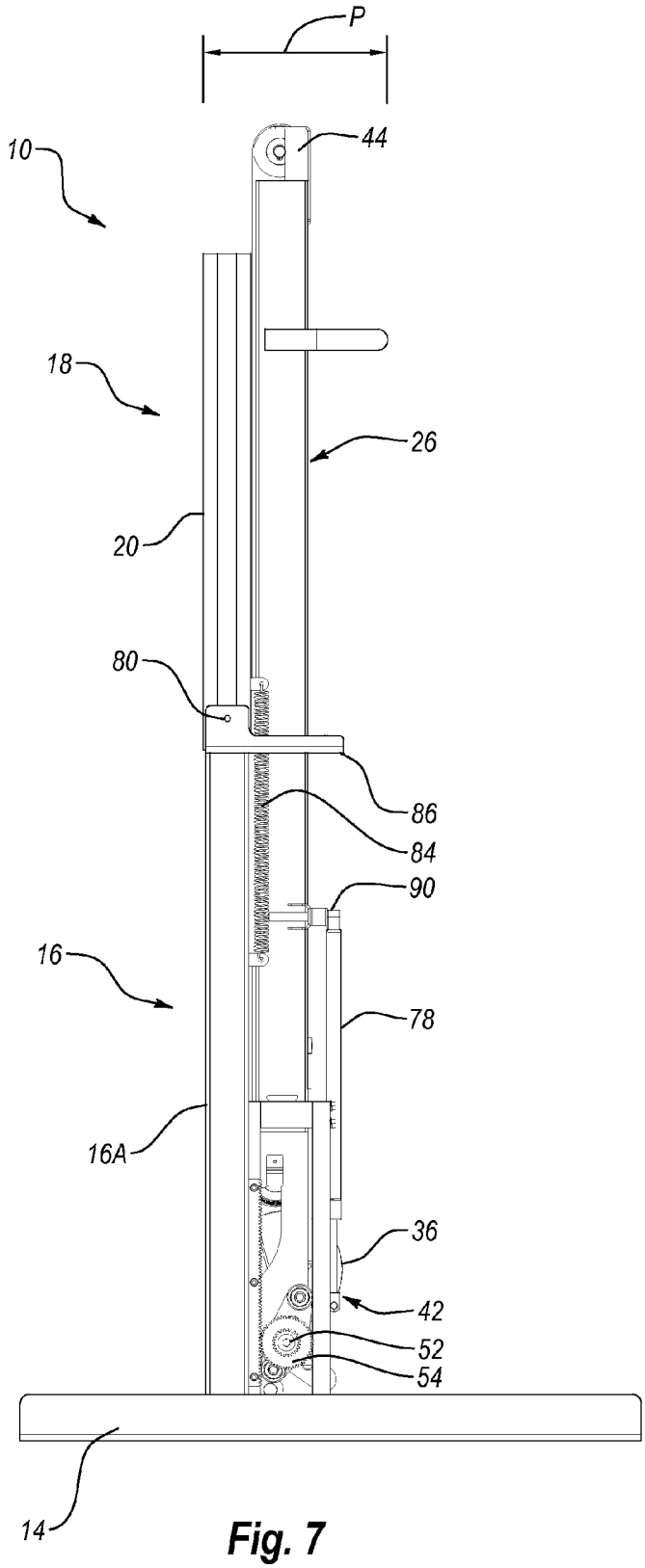
FIG. 7 illustrates a side elevation view of the exercise device of FIG. 1 with a portion of the exercise device folded into a storage position.

As noted above, first end 42 of treadbase 26 is rotatably mounted on rod 52. Rotatably mounting first end 42 on rod 52 enables treadbase 26 to be reoriented or folded from an operating position as shown in FIGS. 1-6 to a storage position as shown in FIG. 7. When treadbase 26 is in the operating position a user is able to ambulate thereon. In contrast, treadbase 26 may be reoriented to the storage position when exercise device 10 is not in use, thereby reducing the footprint of exercise device 10.

Figure 9:
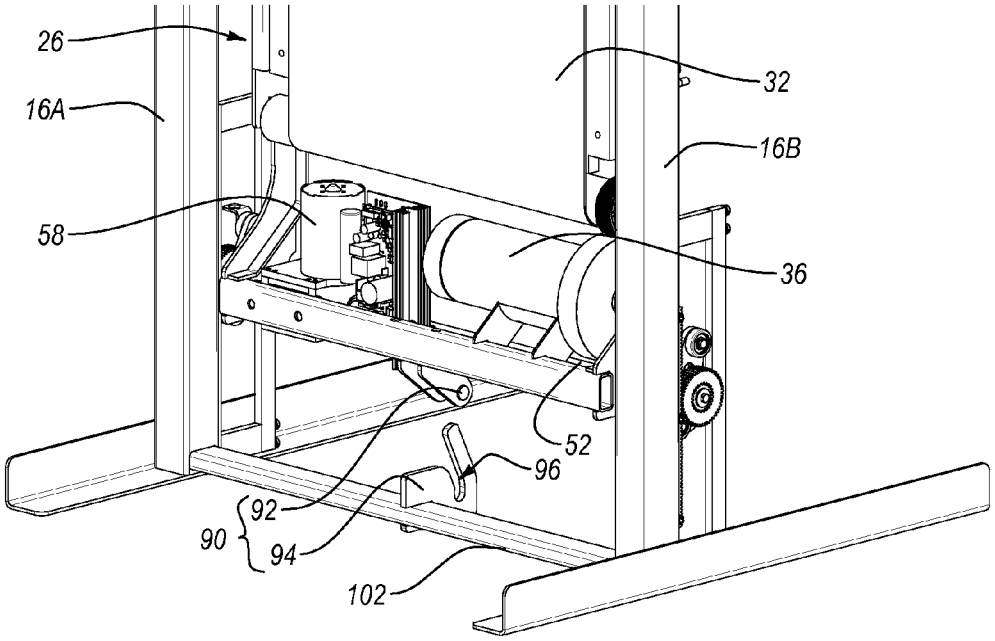
FIG. 9 illustrates a rear perspective view of the exercise device of FIG. 1 with the treadbase in a storage position and the latching mechanism in an unlatched state.

As can be seen in FIG. 7, treadbase 26 is in a substantially vertical orientation when in the storage position. That is, second end 44 of treadbase 26 is positioned substantially directly above first end 42. As can be seen in FIG. 9, as a result of being mounted on treadbase 26, belt drive motor 36 and incline motor 58 also rotate about rod 52 when treadbase 26 is reoriented between the operating and storage positions. In the illustrated embodiment, belt drive motor 36 and incline motor 58 are mounted on treadbase 26 between rod 52 and belt 32. As a result, belt drive motor 36 and incline motor 58 are positioned generally above rod 52 and below belt 32 when treadbase 26 is in the storage position.

In light of the above discussed incline and reorientation capabilities of exercise device 10, it is noted that both the incline and reorientation capabilities are made possible, at least in part, by mounting treadbase 26 on rod 52. More specifically, because first end 42 of treadbase 26 is mounted on rod 52, adjusting the height of rod 52 results in an incline change for treadbase 26. Also, having first end 42 pivotally mounted on rod 52 enables treadbase to be reoriented about rod 52 between the storage and operating positions.

As can be seen in FIGS. 3-5, rod 52 can move vertically up and down within a single plane and with minimal or no horizontal movement. As noted, treadbase 26 can be rotated about rod 52 regardless of the height of rod 52. Thus, treadbase 26 may rotate between operating and storage positions about a pivot point (e.g., rod 52) that can move vertically and with little or no horizontal movement.

Notably, reorienting treadbase 26 between the operating and storage positions also causes handle bar assembly 18 to be reoriented between operating and storage positions. Handle bar assembly 18 is shown in the operating position in FIGS. 1 and 3-5. When handle bar assembly 18 is in the operating position, handle bars 20, 22 extend rearwardly from vertical members 16A, 16B in a generally horizontal direction such that vertical members 16A, 16B and handle bars 20, 22 are generally transverse. In contrast, when handle bar assembly 18 is in the storage position as shown in FIG. 7, handle bars 20, 22 extend upwardly from vertical members 16A, 16B in a generally vertical direction such that vertical members 16A, 16B and handle bars 20, 22 are generally parallel or collinear.

The reorientation of handle bar assembly 18 from the operating position to the storage position is facilitated by pivotally connecting handle bar assembly 18 to support structure 16 and by reorienting treadbase 26 from the operating position to the storage position. More specifically, handle bar assembly 18 is pivotally connected to support structure 16 at pivots 80. Pivots 80 allow handle bar assembly 18 to rotate or pivot thereabout, such as between the operating and storage positions.

When treadbase 26 is reoriented from the operating position to the storage position, treadbase 26 engages handle bar assembly 18 in a manner that causes handle bar assembly 18 to be reoriented from the operating position to the storage position. More specifically, as treadbase 26 is reoriented toward the storage position, the top surface of treadbase 26 engages cross bar 24 of handle bar assembly 18. As treadbase 26 continues to rotate toward the storage position, the force applied to cross bar 24 by treadbase 26 causes handle bar assembly 18 to rotate about pivots 80 toward the storage position. When treadbase 26 has been completely rotated to the storage position, handle bar assembly 18 will also be in its storage position.

As can be seen in FIG. 7, when treadbase 26 and handle bar assembly 18 are both in their storage positions, exercise device 10 has a slim and compact storage profile width, which is indicated at reference P. According to some embodiments, the storage profile width P of exercise device 10 may be about six (6) inches or about eight (8) inches. In other embodiments, the storage profile width P of exercise device 10 may be between about four (4) inches and about twelve (12) inches. As seen in FIG. 7, the storage profile width P of the illustrated embodiment does not include the width or base 14. In other embodiment, however, base 14 may be sized to fit within the compact storage profile width P.

Cushions, such as rubber or foam stops, may optionally be provided on cross bar 24 or treadbase 26 to cushion the engagement and prevent damage therebetween. For instance, as shown in FIG. 1, cross bar 24 is provided with two cushions 82. Cushions 82 are space apart and are positioned on cross bar 24 so as to be engaged by treadbase 26 when treadbase 26 is reoriented toward the storage position. Cushions 82 may be formed of force absorbing, non-abrasive, and/or resilient materials that prevent damage to cross bar 24 or treadbase 26 when treadbase 26 engages cross bar 24.

When treadbase 26 is reoriented from the storage position to the operating position, handle bar assembly 18 may also be reoriented to its operating position. That is, handle bar assembly 18 may pivot about pivots 80 from the storage position shown in FIG. 7 to the operating position shown in FIG. 1. A biasing member may facilitate the reorientation of handle bar assembly 18 from the storage position to the operating position. For instance, as shown in FIGS. 1, 3-5, and 7, a biasing member 84, which is illustrated as a spring, is connected between vertical member 16A and handle bar 20. Biasing member 84 may exert a force on handle bar 20 that biases handle bar assembly 18 toward the operating position. Accordingly, when treadbase 26 is reoriented toward the operating position, biasing member 84 acts on handle bar assembly 18 to likewise reorient handle bar assembly 18 toward its operating position.

Support structure 16 and/or handle bar assembly 18 may include one or more stops or other features that prevent handle bar assembly 18 from rotating beyond the operating or storage positions. In the illustrated embodiment, for instance, vertical members 16A, 16B have stops 86, 88, respectively, that prevent handle bar assembly 18 from rotating beyond the operating position. More specifically, stops 86, 88 extend rearwardly from vertical members 16A, 16B so that handle bars 20, 22 will engage stops 86, 88 when handle bar assembly 18 has rotated from the storage position to the operating position, thereby preventing handle bar assembly from rotating beyond the operating position. Biasing member 84 may likewise act as a stop to prevent handle bar assembly 18 from rotating beyond the storage position. Additionally, or alternatively, one or more stops similar to stops 86, 88 may be provided on vertical members 16A, 16B or handle bar assembly 18 to prevent handle bar assembly 18 from rotating beyond the storage position.

As noted above, gas spring 78 is connected between bracket assembly 66 and treadbase 26. In addition to facilitating continuous and full engagement between pinions 54 and racks 56, gas spring 78 may also assist with the reorientation of treadbase 26. For instance, when a user lifts second end 44 of treadbase 26 to position treadbase 26 in the storage position, gas spring 78 may exert a force on treadbase 26 that assists the user in lifting second end 44. In other words, the force exerted by gas spring 78 may reduce the amount of lifting force that the user has to exert in order to lift treadbase 26 into the storage position. In contrast, when treadbase 26 is being reoriented from the storage position to the operating position, the force exerted by gas spring 78 on treadbase 26 may provide for a more controlled descent of treadbase 26.

Figure 8:
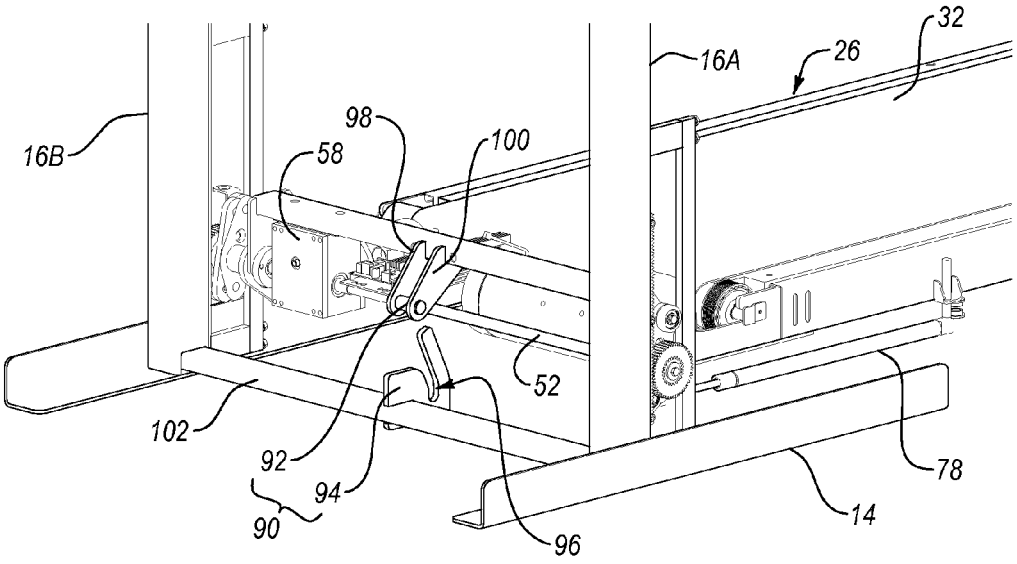
FIG. 8 illustrates an end perspective view of the exercise device of FIG. 1 and a latching mechanism in an unlatched state.
Figure 10:
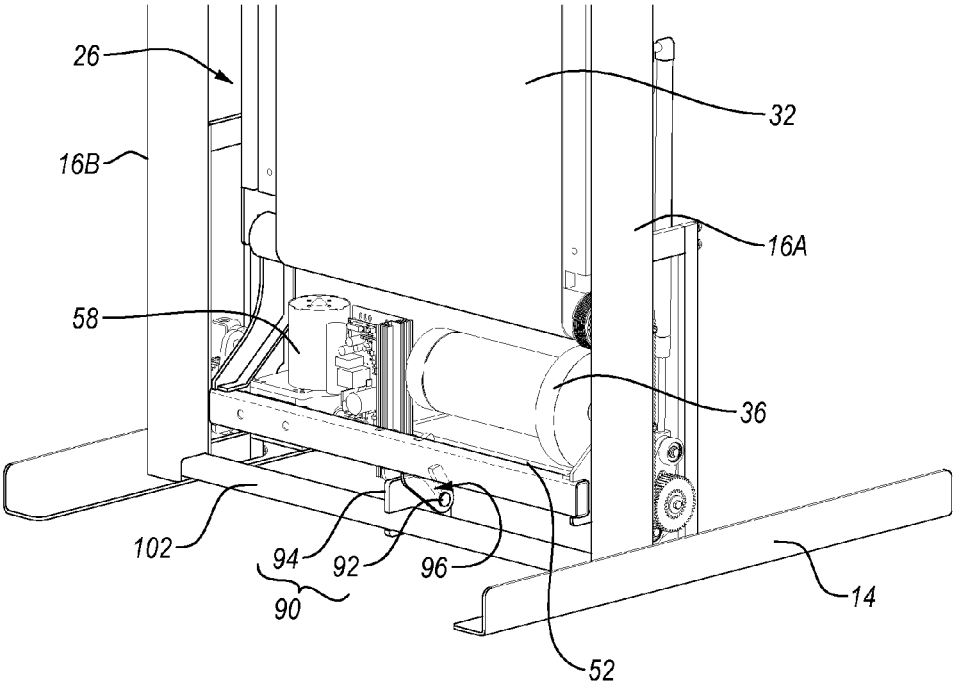
FIG. 10 illustrates an end perspective view of the exercise device of FIG. 1 with the latching mechanism in a latched state.

Attention is now directed to FIGS. 8-10, which illustrate a latching mechanism 90 according to one embodiment of the invention. Latching mechanism 90 selectively maintains treadbase 26 in the storage position. As can be seen in FIG. 8, latching mechanism 90 includes a latch pin 92 and a latch plate 94. Latch pin 92 is able to selectively engage or disengage latch plate 94 to selectively maintain treadbase 26 in the storage position or to allow treadbase 26 to be reoriented to the operating position.

Latch pin 92 is connected to first end 42 of treadbase 26 via brackets 98, 100. As shown, latch pin 92 has a longitudinal axis that is substantially perpendicular to a longitudinal axis of treadbase 26 and that is generally parallel to rod 52. Because latch pin 92 is connected to treadbase 26, latch pin 92 rotates about rod 52 when treadbase 26 is reoriented between the operating and storage positions.

Latch plate 94 is mounted on a cross bar 102 that extends between vertical members 16A, 16B. A channel 96 is formed in latch plate 94. In the illustrated embodiment, channel 96 has a forwardly bent shape. In other embodiments, however, channel 96 may have a rearwardly bent shape or channel 96 may be straight. Regardless of its shape, channel 96 may be designed to selectively receive and retain latch pin 92 therein when treadbase 26 is in the storage position. For instance, channel 96 may have a generally upwardly directed opening for selectively receiving latch pin 92 therein.

When latch pin 92 is positioned in channel 96, the movement of treadbase 26 is restricted to prevent treadbase 26 from inadvertently moving from the storage position to the operating position. Nevertheless, latch pin 92 may be selectively removed from channel 96 to allow treadbase 26 to move to the operating position.

With reference to FIG. 8, exercise device 10 is depicted with treadbase 26 in the operating position. As can be seen, latch pin 92 is disengaged from latch plate 94 (e.g., not positioned within channel 96) when treadbase 26 is in the operating position. As discussed herein, when treadbase 26 is in the operating position, a user may ambulate thereon and the incline of treadbase 26 may be selectively adjusted.

Turning to FIGS. 9 and 10, the manner in which treadbase 26 is latched in the storage position is illustrated. First, treadbase 26 is rotated to the storage position as shown in FIG. 9. When treadbase 26 is in the storage position, latch pin 92 is generally aligned with channel 96 of latch plate 94 so that latch pin 92 may be selectively moved in and out of channel 96. The alignment between latch pin 92 and channel 96 may be in a generally vertical direction, a generally horizontal direction, or an angled direction (e.g., relative to a support surface). That is, for the illustrated embodiment, treadbase 26 is rotated so that second end 44 of treadbase 26 is positioned generally above first end 42 and latch pin 92 is vertically aligned with the generally upwardly directed opening of channel 96. Although treadbase 26 has been rotated to the storage position in FIG. 9, latching mechanism 90 has not been engaged to maintain treadbase 26 in the storage position. Specifically, latch pin 92 is aligned with, but has not been positioned within, channel 96 of latch plate 94. Rather, in the embodiment illustrated in FIG. 9, latch pin 92 is positioned vertically above the opening to channel 96.

To engage latching mechanism 90, latch pin 92 is positioned in channel 96 as shown in FIG. 10. The positioning of latch pin 92 in channel 96 may be accomplished by activating incline motor 58. When treadbase 26 is in the storage position, activation of incline motor 58 changes the vertical position of treadbase 26 and latch pin 92. Thus, once treadbase 26 has been positioned in the storage position as shown in FIG. 9, incline motor 58 may be activated to move treadbase 26 in a generally vertical direction to lower treadbase 26. As treadbase 26 is lowered, latch pin 92 enters and is positioned in channel 96 as shown in FIG. 10. Accordingly, when a user is finished exercising on exercise device 10, the user may lift second end 44 until treadbase 26 is in the storage position, at which point incline motor 58 may be activated to lower treadbase 26 and thereby position latch pin 92 in channel 96.

In contrast, when latching mechanism 90 is engaged and a user desires to use exercise device 10, incline motor 58 may be activated to move treadbase 26 in a generally vertical direction to raise treadbase 26 and thereby withdraw latch pin 92 from channel 96. With latch pin 92 removed from channel 96, treadbase 26 may be rotated from the storage position to the operating position. It is appreciated that latching mechanism 90 may be arranged such that treadbase 26 may be moved in a generally horizontal direction or in an angled direction (e.g., relative to a support surface) in order to position latch pin 92 in or remove latch pin 92 from channel 96.

Figure 11:
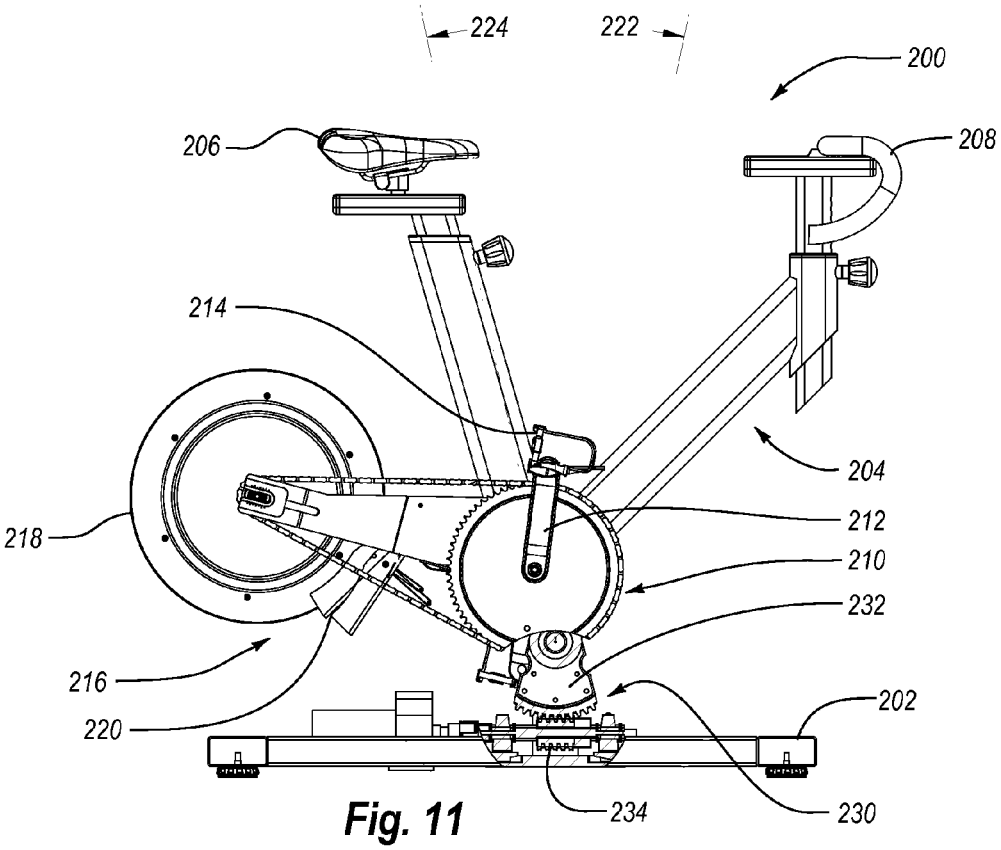
FIG. 11 illustrates an exercise device according to another embodiment of the present invention, with a partial cutaway to reveal an incline mechanism.

Attention is now directed to FIG. 11, which illustrates an exercise device 200, in the form of an exercise cycle, according to another embodiment of the present invention. Exercise device 200, in one embodiment, includes a support base 202 and a generally upright support structure 204 movably coupled thereto. Upright support structure 204 may be referred to as a bicycle frame, although it need not look like, or act like, a bicycle frame of a road or mountain bicycle used in real-world cycling. Support structure 204 of the illustrated embodiment includes a seat 206 upon which a user may sit when exercising on exercise device 200. Support structure 204 includes an optional handlebar assembly 208.

In the illustrative embodiment, a drive assembly 210 is mounted on upright support structure 204 and includes a pair of rotatable cranks 212, each having a pedal 214 which a user can engage with his or her feet to rotate cranks 212. Drive assembly 210 also includes, in this embodiment, a resistance assembly 216, which can affect the force required from the user to rotate cranks 212. Resistance assembly 216 includes a flywheel 218 and a resistance mechanism 220 that may vary the rotational speed of flywheel 218, and thus the force required from the user to rotate cranks 212.

Exercise device 200 also permits varying the vertical pitch (also referred to as incline or decline) of upright support structure 204 relative to support base 202. As shown in FIG. 11, support structure 204 can be oriented in a neutral position. In the neutral position, the illustrated exercise device 200 may include handle bar assembly 208 and seat 206 at generally the same vertical distance from the floor or other support surface, although such is illustrative only, and the handle bar assembly 208 and seat 206 may be at different heights, even in the neutral position. In this embodiment, when upright support structure 204 is in the neutral position, a user sitting on seat 206 may feel that he or she is sitting on a bicycle that is on a generally level surface.

As indicated in FIG. 11 by arrow 222, upright support structure 204 can be tilted so as to be oriented in a forwardly tilted position. In the forwardly titled position, the handle bar assembly 208 may be vertically closer to the floor or other support structure relative to the seat 206, and relative to the position of handle bar assembly 208 in the neutral position. This is achieved by adjusting the vertical pitch of the upright support structure 204 relative to a floor or other support surface. Tilting upright support structure 204 forward as indicated by arrow 222 enables a user to simulate riding down a hill. Due to the sensation of descending a hill, the forwardly titled position may also be considered a declined position.

As indicated in FIG. 11 by arrow 224, upright support structure 204 can also be oriented in a backwardly tilted position in which the handle bar assembly 208 is vertically further from the floor or other support structure when compared to seat 206 or when compared to the position of the handle bar assembly 208 in the neutral position. Tilting upright support structure 204 backwardly as indicated by arrow 224 enables a user to simulate riding up a hill. Due to the sensation of ascending up a hill, the backwardly titled position may also be considered an inclined position.

The forward and backward tilting of upright support structure 204 to adjust the vertical pitch of the support structure 204 can be accomplished through pivotally coupling upright support structure 204 to support base 202 as depicted in FIG. 11. As seen in the cutaway portion of FIG. 11, upright support structure 204 is connected to support base 202 by an incline mechanism 230. In the illustrated embodiment, inclination mechanism 230 includes a worm wheel 232 and a worm 234, each of which has teeth that engage the teeth of the other. Worm wheel 232 is fixedly mounted on or connected to upright support structure 204. As worm 234 rotates about it longitudinal axis, worm 234 causes worm wheel 232 to rotate about it central axis. Since worm wheel 232 is fixedly connected to support structure 204, rotation of worm wheel 232 results in rotation of support structure 204. Rotation of worm 234 in a first direction causes worm wheel 232 and support structure 204 to rotate in the direction of arrow 222, while rotation of worm 234 in a second direction causes worm wheel 232 and support structure 204 to rotate in the direction of arrow 224.

Industrial Applicability

In general, embodiments of the present disclosure relate to exercise devices that incline and/or decline to provide variety in an exercise workout. The exercise devices may be any type of exercise device, such as a treadmill, an exercise cycle, a Nordic style ski exercise device, a rower, a stepper, a hiker, a climber, an elliptical, or a striding exercise device. The inclining and declining capabilities of the disclosed exercise devices allow the exercise devices to simulate real-world terrain or otherwise vary the operation of the exercise device. For instance, a treadmill may have an incline mechanism that adjusts the angle of the treadbase to simulate a descent down a hill, an ascent up a hill, or traversing across level ground.

While exercise devices have included inclining and declining mechanisms, typically lead-screw type extension devices, for adjusting the angle of the exercise devices, these inclining and declining mechanisms have typically been large and aesthetically unappealing. For instance, in order to provide a desirable range of motion for the exercise device, these mechanisms have required relatively long extension members, such as a relatively long lead screw movably positioned within a relatively long lead cylinder. The length of these extension members allowed for the long lead screw to move significant distances into and out of the lead cylinder, thereby allowing for the desired range of motion for the exercise device. Nevertheless, the length of these extension members increased the overall profile of the exercise device. For instance, in order to fit these long extension members under the treadbase of a treadmill, the treadbase would have to be elevated further off the floor. Furthermore, achieving large incline ranges proved difficult with typical extension mechanisms.

Embodiments of the present disclosure provide a simple and efficient mechanism for adjusting the incline or decline of an exercise device. The disclosed embodiments are compact, thereby allowing for an aesthetically pleasing, low profile exercise device. For instance, in the case of treadmills, the compact incline mechanisms are not positioned underneath the treadbase, thereby allowing the treadbase to have a lower profile. Additionally, not having the incline mechanism underneath the treadbase allows the exercise device to be significantly declined without interference from the incline mechanism. Furthermore, the incline mechanism allows the exercise device to be inclined significantly without having to use long, space-consuming extension members.

In some instances, the incline mechanism of the present invention includes a rod upon which a first end of a treadbase is rotatably mounted. A pinion is mounted on at least one end of the rod. An incline motor rotates the rod, which causes the pinion to ride up or down a rack or linear gear bar. As the pinion rides up or down the rack, the height of the first end of the treadbase is increased or decreased, thereby altering the incline of the treadbase. The pinion may rotate between various positions on the rack which correspond to various inclines/declines of the treadbase, including fully inclined, fully declined, and neutral positions.

According some embodiments, the incline mechanism enables the treadbase to be moved to substantially any grade between about a −5% grade in the fully declined position to about a 30% grade in the fully inclined position. In other embodiments, the incline mechanism may enable the treadbase to move between grades less than −5% and greater than 30%, or between grades that are less extreme than −5% and 30%. For instance, the incline mechanism may enable the treadbase to decline to about a −20% grade and incline to about a 45% grade. In still other embodiments, the incline mechanism may enable the incline of the treadbase to be adjusted between grades of between about −15% to 35%, between about −10% to 40%, between about 0% to 50%, between about −10% to 25%, or between combinations thereof.

The length of the racks may be longer than illustrated in the Figures. For instance, in order to enable the noted inclination ranges, the racks may extend up any portion or the entire height of the vertical members. By way of example, the racks may extend from about the base to about halfway up the vertical members as shown in the Figures. Alternatively, the racks may extend less than halfway up the vertical members if a smaller inclination range is desired. Similarly, the racks may extend more than halfway or substantially the entire way up the vertical members if a larger inclination range is desired. Still further, the racks may extend along any portion of the vertical members, whether the lower ends of the racks are positioned adjacent the base. For instance, the racks may extend from just below the handle bar assembly down a portion of the vertical members. In still other embodiments, the racks may extend along a portion of the vertical members such that the upper and lower ends of the racks are spaced apart from the handle bar assembly and the base.

In some embodiments, the racks do not extend up and/or are not aligned with the vertical members. For instance, the racks may be spaced apart from the vertical members closer to the first or second end of the exercise device and/or closer to or further away from the center of the exercise device. The racks may also be oriented at an angle relative to the vertical members. For instance, the lower ends of the racks may be positioned closer to the second end of the treadbase than the upper ends of the racks. In such a case, as the pinions roll up and down the racks, the first end of the treadbase may move vertically and horizontally.

Using a rack and pinion incline mechanism provides significant benefits. For instance, the rack and pinion arrangement requires little or no space underneath the treadbase. As a result, the treadbase may have a very low profile and may be declined to a greater degree without increasing the height of the treadbase. For instance, to provide a treadmill with declining capabilities, the treadbase is typically raised to provide room thereunder for a typical (e.g., large or long) extension device as well as room for the treadbase to pivot down. In contrast, the rack and pinion incline mechanism disclosed herein is not positioned underneath the treadbase, thereby allowing for the treadbase to pivot down without having to significantly increase the height of the treadbase.

The ranges of inclines achievable with the rack and pinion incline mechanism are limited essentially only by the length of the rack. This provides the exercise device with a wide range of motion from a relatively small, unobtrusive incline mechanism. Depending on the length of the rack, such incline mechanism may allow the grade of the treadbase to change by up to about 65%, such as between grades of about −20% to about 45%, or between other ranges therebetween.

In addition to providing significant incline ranges, the present invention may also include a guide and bracket assembly to maintain full engagement between the racks and pinions of the incline mechanism. The bracket assembly is continuously biased in a certain direction to maintain engagement with the guide, thereby causing the bracket assembly to travel back and forth within the guide in a straight line with minimal lateral movement. The pinions are mounted adjacent the bracket assembly and move in the same direction as the bracket assembly. As a result, the movement of the pinions is limited to rolling within a straight line. This leads to the pinions being continuously maintained in full engagement with the racks.

In other embodiments, the bracket assembly is omitted. In order to maintain full engagement between the pinions and the racks and to direct the movement of the incline mechanism as the incline of treadbase is adjusted, the pinions (or a portion thereof) may be positioned within the opening in the guide. For instance, the openings may be sized to receive at least a portion of the pinions therein such that the pinions are only able to move within a single plane. Furthermore, in some embodiments the racks may be formed or mounted on the inner surfaces of the openings and the toothed portions of the pinions may be positioned within the openings so as to be able to engage the racks.

As noted, the first end of the treadbase is rotatably mounted on the same rod upon which the pinions are mounted. As a result, movement of the pinions up and down the racks changes the height of the first end of the treadbase. In addition, the treadbase may be rotated about the rod to reorient the treadbase between an operating position and a storage position.

The exercise devices of the present invention may also include handle bar assemblies that may be reoriented between operating and storage positions. For instance, the handle bar assembly may rotate between a generally horizontal operating position and a generally vertical storage position. In the operating position, the handle bar assembly may be positioned and arranged for a user to hold during the performance of an exercise. In contrast, the handle bar assembly may be positioned and arranged to minimize the footprint of the exercise device when the handle bar assembly is in the storage position.

In some embodiments, the handle bar assembly may be reoriented from the operating position to the storage position when the treadbase is reoriented from its operating position to its storage position. More specifically, as the treadbase is being pivoted from its operating position to its storage position, the treadbase may engage the handle bar assembly and cause the handle bar assembly to rotate from its operating position to its storage position. In contrast, the exercise device may also include a biasing member that biases the handle bar assembly toward its operating position when the treadbase is not in its storage position.

When the treadbase and the handle bar assembly are both pivoted to their storage positions, the exercise device may have a relatively thin storage profile. In some embodiments, the storage profile may be as small as about six (6) inches or about eight (8) inches. In other embodiments, the storage profile may be between about four (4) inches and about twelve (12) inches. Accordingly, the exercise devices of the present invention may be compactly stored during shipment, storage, or periods of non-use.

A latching mechanism may also be included on the exercise devices of the present invention. The latching mechanism may include a latch pin and latch plate having a channel formed therein for selectively receiving the latch pin. The latch pin may be connected to the first end of the treadbase and may be disengaged from the latch plate when the treadbase is in the operating position. When the treadbase is in the storage position, the latch pin may be aligned and selectively received within the channel in the latch plate. Once the treadbase is in the storage position, the latch pin may be positioned within the channel by activating the incline motor to lower the treadbase toward the latch plate. As the treadbase is lowered toward the latch plate, the latch pin is received within the channel. The channel may be designed to hold the latch pin therein to prevent the treadbase from inadvertently rotating from the storage position to the operating position.

Various portions of the latching and unlatching of the latching mechanism may be at least partially automated. For instance, a switch or sensor may be activated as the treadbase is reoriented from the operating position to the storage position. Activation of the switch or sensor may in turn activate the incline motor so that incline motor lowers the treadbase toward the latch plate, thereby positioning the latch pin in the channel. Likewise, a user input may be provided that activates the incline motor to disengage the latch mechanism. In particular, upon activation of the user input, the incline motor is activated to raise the treadbase, thereby withdrawing the latch pin from channel. When the latch pin is removed from the channel, a gas spring may facilitate a controlled descent of the treadbase from the storage position to the operating position. In addition, the gas spring may also initiate the reorientation of the treadbase from the storage position to the operating position once the latch pin is removed from the channel, thereby eliminating the need for the user to pull the second end of the treadbase down toward the support surface.

In some instances, such as with an exercise cycle, the incline mechanism of the present invention includes a worm wheel fixedly mounted on an upright support structure and a worm connected to a base support. Rotation of the worm causes the worm wheel, and thus the upright support structure, to rotate in order to position the upright support structure in a forwardly titled or declined position or in a backwardly titled or inclined position. The worm wheel may be rotated by the worm between various positions that correspond to various inclines/declines of the upright support structure, including fully inclined, fully declined, and neutral positions. Like the other inclination mechanisms described herein, the worm gear-type inclination mechanism is compact and unobtrusive. In some embodiments, this type of inclination mechanism can allow an upright support structure to tilt forward or backward as much as about 20°. For instance, the inclination mechanism may allow the upright support structure to tilt about 12° back and about 12° forward.

What is claimed is:

1. A selectively inclining treadmill which supports a user ambulating thereon, the selectively inclining treadmill comprising:

a frame;

a treadbase pivotally connected to the frame, the treadbase having a first end and a second end, the treadbase being selectively movable between a declined position, a neutral position, and an inclined position relative to a support surface; and an incline mechanism that selectively moves the treadbase between the declined, neutral, and inclined positions, the incline mechanism comprising:

a rack connected to the frame; and a pinion rotatably connected to the first end of the treadbase, wherein the pinion selectively rotates up and down the rack to move the treadbase between the declined, neutral, and inclined positions;

a bracket assembly, a guide that directs movement of the bracket assembly, and a gas spring;

wherein the gas spring applies a continuous force to rotate the bracket assembly to maintain full engagement between the pinion and the rack.

2. The selectively inclining treadmill of claim 1, wherein the incline mechanism further comprises a motor that selectively rotates the pinion up and down the rack.

3. The selectively inclining treadmill of claim 1, wherein the incline mechanism enables the treadbase to decline to about a −5% grade and incline to about a 30% grade relative to the support surface.

4. The selectively inclining treadmill of claim 1, wherein the rack and the pinion each comprises a plurality of teeth that engage one another.

5. The selectively inclining treadmill of claim 1, wherein the first end of the treadbase is rotatably mounted on a rod to enable the treadbase to be selectively reoriented between an operating position and a storage position.

6. The selectively inclining treadmill of claim 5, wherein the treadbase is generally vertically oriented when the treadbase is in the storage position.

7. The selectively inclining treadmill of claim 5, wherein the pinion is mounted on the rod.

8. The selectively inclining treadmill of claim 5, wherein the rod moves generally vertically with substantially no horizontal movement as the treadbase moves between the declined, neutral, and inclined positions.

9. The selectively inclining treadmill of claim 1, further comprising a handle bar assembly pivotally connected to the frame, wherein the handle bar assembly may be selectively reoriented between an operating position and a storage position.

10. The selectively inclining treadmill of claim 9, wherein the handle bar assembly is reoriented from the operating position to the storage position when the treadbase is reoriented from an operating position to a storage position.

11. The selectively inclining treadmill of claim 10, wherein the treadmill has a storage profile width of between about 4 inches and about 12 inches when the treadbase and handle bar assembly are in the storage positions.

12. The selectively inclining treadmill of claim 1, wherein the guide comprises an opening formed therein, and wherein at least a portion of the bracket assembly moves back and forth within the opening as the incline mechanism moves the treadbase between the declined, neutral, and inclined positions.

13. The selectively inclining treadmill of claim 1, further comprising a latching mechanism, the latching mechanism comprising:

a latch plate connected to the frame, the latch plate having a channel formed therein; and a latch pin connected to the first end of the treadbase, wherein the latch pin may be selectively lowered into the channel when the treadbase is in a storage position, wherein the latch pin and the channel cooperate to maintain the treadbase in the storage position when the latch pin is positioned within the channel.

14. The selectively inclining treadmill of claim 13, wherein the latch pin is lowered into the channel by activating the incline mechanism.

15. The selectively inclining treadmill of claim 1, further comprising a foot connected to the second end of the treadbase, wherein the foot elevates the second end of the treadbase far enough above a support surface so that the first end of the treadbase may be lowered so that treadbase is declined to a grade of about −4%.

16. A selectively reorienting treadmill, comprising:

a frame that rests upon a support surface;

a treadbase pivotally connected to the frame, the treadbase having a first end and a second end, the treadbase being selectively movable between an operating position and a storage position; and a latching mechanism that selectively maintains the treadbase in the storage position, the latching mechanism comprising:

a latch plate connected to the frame, the latch plate having a generally upwardly opening channel formed therein;

a latch pin connected to the first end of the treadbase, wherein the latch pin may be selectively lowered into the channel when the treadbase is in the storage position, wherein the latch pin and the channel cooperate to maintain the treadbase in the storage position when the latch pin is positioned within the channel;

an incline mechanism that selectively moves the treadbase between the declined, neutral, and inclined positions, the incline mechanism comprising:

a rack connected to the frame; and a pinion rotatably connected to the first end of the treadbase, wherein the pinion selectively rotates up and down the rack to move the treadbase between the declined, neutral, and inclined positions;

a bracket assembly, a guide that directs movement of the bracket assembly, and a gas spring;

wherein the gas spring applies a continuous force to rotate the bracket assembly to maintain full engagement between the pinion and the rack.

17. The selectively reorienting treadmill of claim 16, wherein the latch pin is lowered into the channel by lowering the treadbase closer to the latch plate.

18. The selectively reorienting treadmill of claim 17, wherein the incline mechanism selectively adjusts the height of the first end of the treadbase when the treadbase is in the operating position and lowers the treadbase to position the latch pin in the channel when the treadbase is in the storage position.

19. The selectively reorienting treadmill of claim 16, wherein the latch pin is oriented for vertical engagement with the latch plate when the treadbase is in the storage position.

20. A treadmill, comprising:

a frame;

a treadbase pivotally connected to the frame, wherein the treadbase may be selectively reoriented between an operating position and a storage position, and wherein the treadbase is selectively movable between a declined position, a neutral position, and an inclined position when the treadbase is in the operating position;

a latching mechanism having a latch pin connected to the treadbase and a latch plate with a channel formed therein connected to the frame, wherein the channel selectively receives the latch pin when the treadbase is in the storage position to selectively maintain the treadbase in the storage position;

an incline mechanism that selectively moves the treadbase between the declined, neutral, and inclined positions when the treadbase is in the operating position and that selectively lowers the treadbase to position the latch pin within the channel when the treadbase is in the storage position;

the incline mechanism comprising:

a rack connected to the frame; and a pinion rotatably connected to a first end of the treadbase, wherein the pinion selectively rotates up and down the rack to move the treadbase between the declined, neutral, and inclined positions;

a bracket assembly, a guide that directs movement of the bracket assembly, and a gas spring;

wherein the gas spring applies a continuous force to rotate the bracket assembly to maintain full engagement between the pinion and the rack.

* * * * *